US008740640B2

(12) United States Patent
Hardy

(10) Patent No.: US 8,740,640 B2
(45) Date of Patent: Jun. 3, 2014

(54) CONNECTOR PLUG HAVING AN LED ACTIVATED BY A USER'S TOUCH

(71) Applicant: Cellco Partnership, Basking Ridge, NJ (US)

(72) Inventor: Michael Peter Hardy, Warren, NJ (US)

(73) Assignee: Cellco Partnership, Basking Ridge, NJ (US)

( * ) Notice: Subject to any disclaimer, the term of this patent is extended or adjusted under 35 U.S.C. 154(b) by 25 days.

(21) Appl. No.: 13/651,575

(22) Filed: Oct. 15, 2012

(65) Prior Publication Data

US 2014/0106611 A1 Apr. 17, 2014

(51) Int. Cl.
*H01R 3/00* (2006.01)

(52) U.S. Cl.
USPC ..... 439/490

(58) Field of Classification Search
CPC .. H01R 13/465; H01R 13/641; H01R 13/717; H01R 13/7175; H01R 13/6641
See application file for complete search history.

(56) References Cited

U.S. PATENT DOCUMENTS

| | | | | |
|---|---|---|---|---|
| 7,004,595 | B1 * | 2/2006 | Stoddard | 362/95 |
| 7,049,937 | B1 * | 5/2006 | Zweig et al. | 340/657 |
| 2006/0039136 | A1 * | 2/2006 | Probasco et al. | 362/157 |
| 2008/0099313 | A1 * | 5/2008 | Dhir | 200/51.12 |
| 2008/0102689 | A1 * | 5/2008 | Dhir | 439/490 |
| 2008/0298578 | A1 * | 12/2008 | Regen et al. | 379/430 |
| 2012/0064758 | A1 * | 3/2012 | Grice et al. | 439/490 |

* cited by examiner

*Primary Examiner* — Chandrika Prasad

(57) ABSTRACT

An improved apparatus for charging a cell phone battery in the dark. An LED and its control circuitry including a control switch are included in a USB connector to automatically illuminate a cell phone and its charging port or receptacle or jack, which happen to be located in an unlit or pitch black space, when a user attempts to insert a USB connector plug into the charging port for purposes of charging the battery. The LED is automatically energized by the user's mere touching of the overmold of the USB connector at its flat or bottom side, without otherwise manually operating the control switch, and thereby eliminating hunting in the dark for a control switch on the USB connector. This apparatus is useful with both standard charging equipment and with dongle charging equipment.

11 Claims, 5 Drawing Sheets

CONNECTOR PLUG HAVING AN LED ACTIVATED BY A USER'S TOUCH

BACKGROUND

Cell phones are commonplace today with hundreds of millions of cell phone users around the globe. A cell phone (cellular phone or mobile phone), being a mobile device, requires a battery in the cell phone chassis to power the phone. This battery needs to be recharged regularly, if not daily by connecting it to a power source. One frustrating aspect of charging this battery in complete darkness, e.g., when in an unlit room or other dark space, is to conveniently illuminate the relevant space and thereby locate the charging receptacle or port, typically a micro USB jack, on the cell phone chassis and to properly orient the charging plug relative to the jack. Applicant hereby provides a convenient and novel solution to this problem.

DETAILED DESCRIPTION OF PREFERRED EMBODIMENTS

Figure 1A:
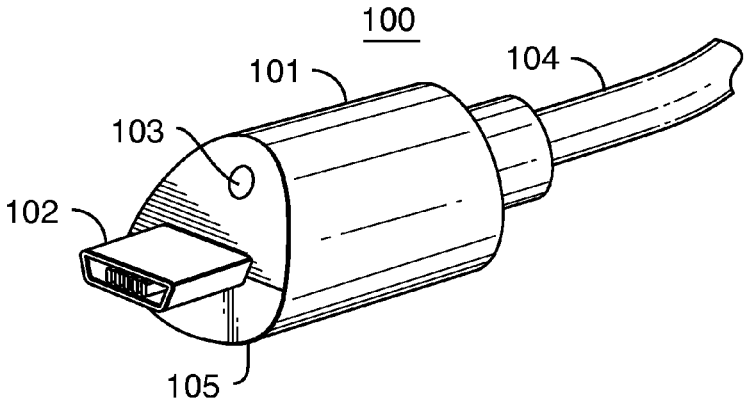
FIG. 1A is a perspective diagram of an exemplary embodiment of a connector plug which includes apparatus related to the present invention.

In this description, the same reference numeral in different Figs. refers to the same entity. Otherwise, reference numerals of each Fig. start with the same number as the number of that Fig. For example, FIG. 3 has numerals in the "300" category and FIG. 4 has numerals in the "400" category, etc.

In overview, embodiments of the present invention include connector apparatus, such as a universal serial bus (USB bus) connector plug, typically a micro USB connector plug, holding a light emitting diode (LED). The LED is supported by, and oriented in, the connector plug in a manner to allow the LED to shine light on the connector plug mate located on a cell phone, and this is very useful when in the dark or in pitch blackness. The light shines when a user merely touches the over-mold of the connector. The user then brings the connector in close proximity to the connector mate to illuminate it. This embodiment is particularly useful for making the connection to recharge the cellular telephone's rechargeable battery, through a micro USB port on the cell phone, by way of a USB bus, when in the dark, because the LED light illuminates both the cell phone and its connector mate, not to mention the immediate environment as well. This allows the user to easily make the connection between connector plug and connector jack in the dark. The bus, at the end opposite to that of the connector is conductively connected, either directly or through another connector plug/jack combination, to an electric power source. Two wires in the bus are dedicated to carrying electric power from that power source to the LED.

In applications other than only re-charging a battery, the bus cm include other wires, isolated and insulated from the power wires, thr carrying data, packets, etc. The connector and its mate are configured to pass-through the data and/or packets from their source to their destination on conductive paths insulated and isolated from the LED power paths. And in another application, unrelated to charging a cell phone, the above-noted another connector plug/jack combination can include another control switch to operate the LED from the opposite end of the bus, the end next to the power source, discussed further below.

In a particular embodiment, a connector plug (plug) is affixed to one end of a cable, the plug having a flat or bottom side and a front face for mating with a connector-mate (jack). There are electrical contacts protruding from the front face of the plug. There is an LED supported by the plug and recessed into the front face to allow light emitted from the LED to illuminate the jack when being connected, while not interfering with the front face. There is a source of electric power applied to the other end of the cable, the power being carried by two dedicated wires in the cable to terminals on the LED, thereby energizing the LED and allowing it to emit light, under control of a user. A switch is included within the plug, the switch automatically closing when the user merely touches the flat or bottom side of the plug, without otherwise manually operating, the switch. The LED light illuminates the jack when the switch is closed and when the plug is being mated with the jack by the user. Typically, the plug is as micro USB plug and the jack is a micro USB jack.

FIG. 1A is a perspective diagram of an exemplary embodiment of a connector plug related to the present invention. In FIG. 1A, connector 100 is a micro USB plug depicted in perspective and shows over-mold 101 supporting electrical contacts 102 that protrude from front face 105. Over-mold 101 contains LED 103 which is oriented so that its light, when energized, shines directly ahead relative to from face 105, in the direction pointed-to by contacts 102. Cable 104 is connected from connector 100 to a source knot shown) of electric power.

Figure 1B:
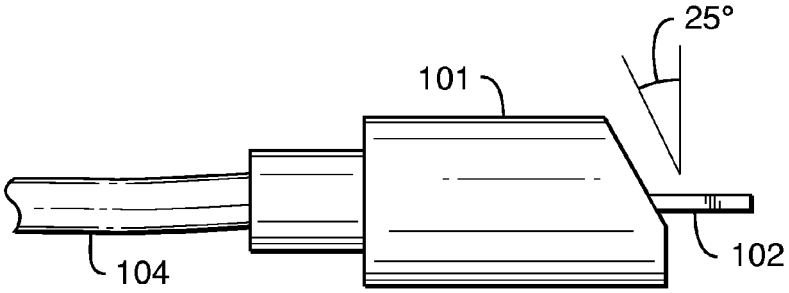
FIG. 1B is a side view of the exemplary embodiment of FIG. 1A.

FIG. 1B shows a side view of connector 100, and it is seen that at least a portion of the front face is angled to permit proper interfacing or mating with a complementarily-angled front face on the connector mate (not shown). In a particular embodiment, that angle can be approximately twenty-five degrees, as shown.

Figure 1C:
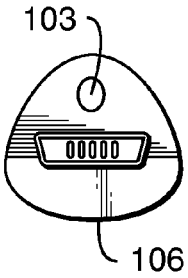
FIG. 1C is a front view of the exemplary embodiment of FIG. 1A.

FIG. 1C is a front view of the exemplary embodiment of FIG. 1A. Flat or bottom surface 106 of over-mold 101 of micro USB plug 100 is identified. LED 103 is shown positioned above contacts 102.

Figure 2:
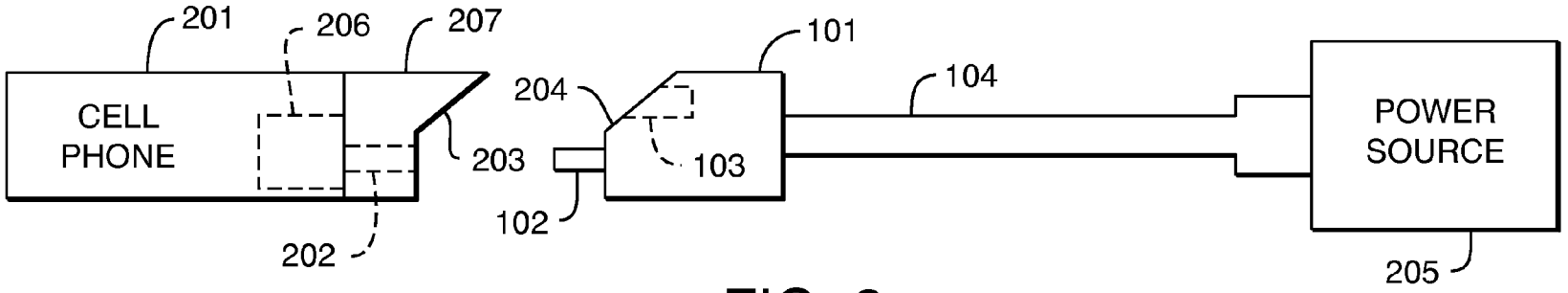
FIG. 2 is a functional block diagram including the exemplary connector plug embodiment of FIG. 1 in relationship to a power source and a cell phone (battery) to be charged.

FIG. 2 is a functional block diagram including the exemplary connector plug embodiment of FIG. 1 connected from a power source and depicting a cell phone battery which may be charged thereby. At the left-hand side of the drawing, cell phone 201 includes its rechargeable battery 206. Battery 206 is conductively connected to cell phone circuitry (not shown) and to battery-charging electrical contacts 202 of connector-mate or micro USB jack 207. Contacts 202 are configured to receive, and make good electrical contact with, contacts 102 supported by connector plug 100. Slanted face 203 on connector-mate 207 dovetails with angled face 204 on connector plug 100 to allow a complementary interfacing there-between. LED 103 is powered by dedicated conductive wiring (not shown) located in cable 104 and connected to power source 205, which is a DC source of electrical power. Power source 205 can be a DC source derived from AC power, such as that obtained from ordinary household 120 volt, 60 cycle power or, alternatively, can be a portable DC battery which is used with a dongle for purposes of charging a cell phone, in which case cable 104 would be a dongle.

Figure 3:
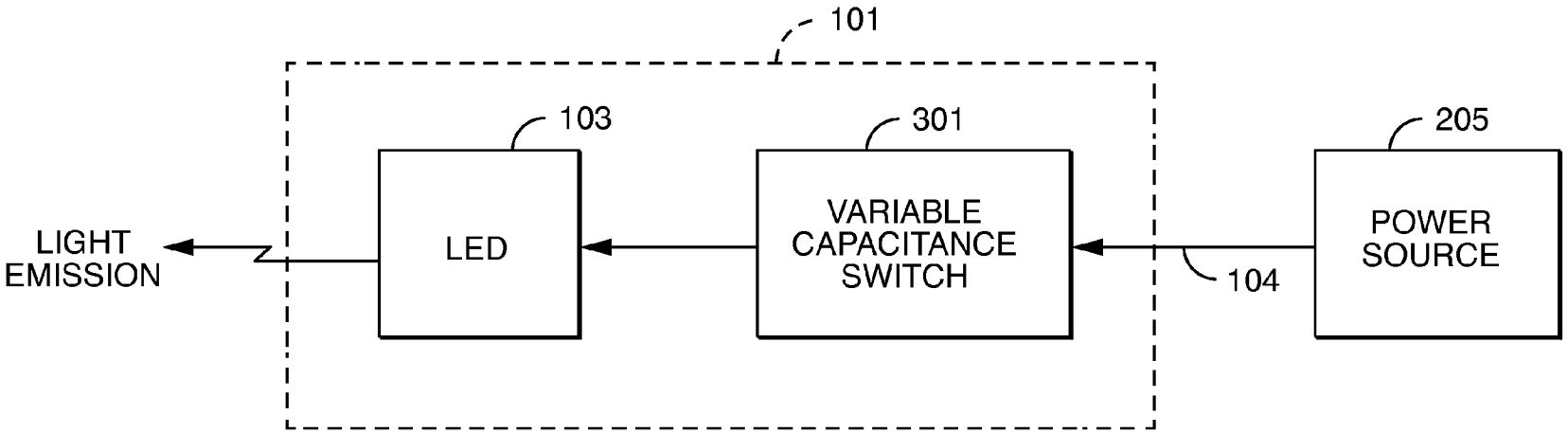
FIG. 3 is another functional block diagram showing more detail of the connector plug embodiment of FIG. 2.

FIG. 3 is another functional block diagram showing more detail of the connector plug embodiment of FIG. 2. Overmold 101 is shown containing LED 103 and variable capacitance switch 301. Switch 301 is arranged to control LED 103. Switch 301 is connected from power source 205 via cable 104 and, depending on the state of the switch, either permits, or doesn't permit, power from power source 205 to be applied to LED 103. When power is applied to the LED it emits light; when power is not applied to the LED it doesn't emit light. LED 103 can be a commercially available white light LED which is powered by levels of voltage and current that are typical of those needed for powering a commercially available LED.

Figure 4:
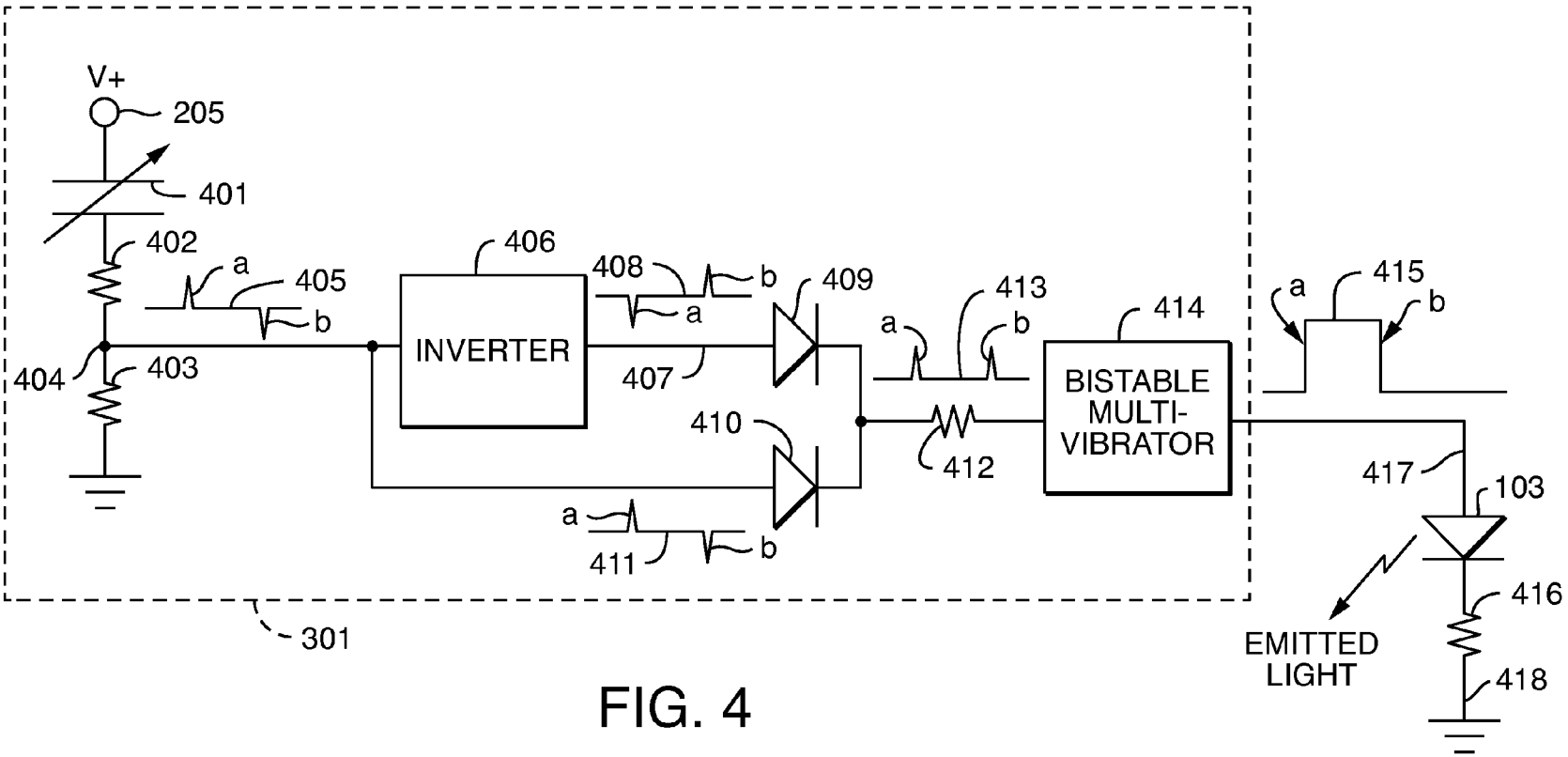
FIG. 4 is a circuit schematic diagram of an exemplary circuit that may be used in and/or with one or more functional blocks of FIG. 3.

FIG. 4 includes an exemplary electrical circuit that ma be used to implement the variable capacitance switch 301 of FIG. 3. Voltage V+ is derived from power source 205, is a constant voltage, and is applied across variable and touch-sensitive capacitor 401 and resistors 402 and 403 to ground. Junction 404 is conductively connected to the input of inverter 406 and also to the anode of diode 410. The output of inverter 406 is applied to the anode of diode 409. The cathodes of diodes 409 and 410 are conductively connected to each other and to one end of resistor 412, the other end of resistor 412 being connected to the control input of bistable multivibrator 414.

In operation, before a user touches the flat or bottom portion of overmold 101 of the micro USB plug 100, capacitance 401 is at a quiescent or fixed or default capacitance value wherefore current flow from constant dc voltage source V+ to ground via resistors 402 and 403 is zero and remains zero while capacitance 401 is in this default capacitance value state. In this state all voltage from V+ is impressed across capacitor 401. However, when a user touches the bottom, or flat side, of overmold 101, as the user would do when attempting to connect electrical contacts 102 to electrical contacts 202, capacitor 401 suddenly changes its capacitance value, and this causes LED 103 to be energized and emit light.

The equation for electrical charge on a capacitor is Q=CV, where Q is charge, C is capacitance and V is voltage. Since electrical current is the flow of electrical charge, or the time rate of change of electrical charge, one can derive an equation for current from this charge equation using differential calculus by differentiating both sides which gives I=dQ/dt=C(dV/dt)+V(dC/dt). Because voltage V+ is constant in this embodiment, (dV/dt) is zero. But, when the capacitance value C changes, the quantity (dC/dt) is non-zero wherefore current I changes from zero to some non-zero value.

If touch-sensitive capacitor 401 is configured so that touching the bottom side of overmold 101 increases its capacitance value, then (dC/dt) is a momentary positive change, wherefore the change in current is from zero to a positive current flow from V+ to ground. Conversely, when the user lets go of the overmold, removing that touching decreases capacitance value of capacitor 401 from that previously increased value back down to the default capacitance value, and (dC/dt) is a momentary negative value, wherefore the change in current is from zero to a negative current flow from ground to V+.

Under the opposite condition, if touching the bottom side of overmold decreases capacitance value of capacitor 401, then opposite capacitance changes from those described above with opposite momentary current flows from those described above would be experienced.

Current shall flow when the capacitance value changes and not when the capacitance value is constant at either the default quiescent value (untouched overmold) or at the changed quiescent value (touched overmold). This current dynamic is illustrated in FIG. 4. Waveform 405 represents current flow from V+ to ground and, by voltage divider action of resistors 402 and 403, also represents voltage at node 404. Current flows from V+ to ground when the flat bottom side of overmold 101 is touched by the user (provided that capacitance of capacitor 401 is thereby increased) at a time coincident with pulse 405*a*. Current flows in the reverse direction from around to V+ when overmold 101 is dropped by the user (wherefore capacitance of capacitor 401 is thereby decreased) at a time coincident with pulse 405*b*. Waveform 405*a* results from a positive capacitance change and is shown as a positive current flow from V+ to ground or as a positive voltage at node 404; waveform 405*b* results from a negative capacitance change (back to default quiescent value) and is shown as a negative current flow from ground to V+ or as a negative voltage at node 404.

Because of voltage divider action of resistors 402 and 403, waveform 405, as noted above, also represents voltage at node 404 which is the voltage input to inverter 406 and to the anode of diode 410. (Waveforms 405 and 411 are essentially identical.) Waveform 408, which is the output from inverter 406, is the inverse of its input and is, therefore, the inverse of waveform 411.

At the time when positive voltage represented by pulse 411*a* is applied to the anode of diode 410, the time when the user grabs the overmold, the negative voltage represented by 408*a* is simultaneously applied to the anode of diode 409. This results in anode 410 being forward-biased wherefore it conducts current while anode 409 is simultaneously reverse biased and does not conduct. This causes a positive voltage related to, and synchronized with, pulse 411*a*, a positive trigger pulse, to be applied to resistor 412, the input control resistor of bistable multivibrator 414, which causes the multivibrator to change state and remain in that changed state until subsequently triggered again. This change of state allows power to be applied, to the LED during the period of that changed state, and the LED then emits light.

However, at a future time when negative voltage represented by pulse 411*b* is applied to the anode of diode 410, the time when the user drops, or stops touching, the overmold, the positive voltage represented by 408*b* is simultaneously applied to the anode of diode 409. This gives the opposite result of anode 410 now being reverse biased and not conducting current while anode 409 is simultaneously now forward biased and conducting current. This again causes a positive voltage, another positive trigger pulse, but this time related to pulse 408*b*, to be applied to resistor 412 which again causes bistable multivibrator 414 to change state—back to its previous state. This return of state removes power from the LED which then shuts off and stays off unless and until bistable multivibrator is once again triggered.

Waveform 415 may represent the output voltage from bistable multivibrator 414, depicting either zero or non-zero voltage, the non-zero voltage value being sufficient to energize LED 103. The LED is shut off during the zero voltage value. Edge "a" of waveform 415 coincides with trigger pulse 413*a* and edge "b" of waveform 415 coincides with trigger pulse 413*b*.

Figure 5:
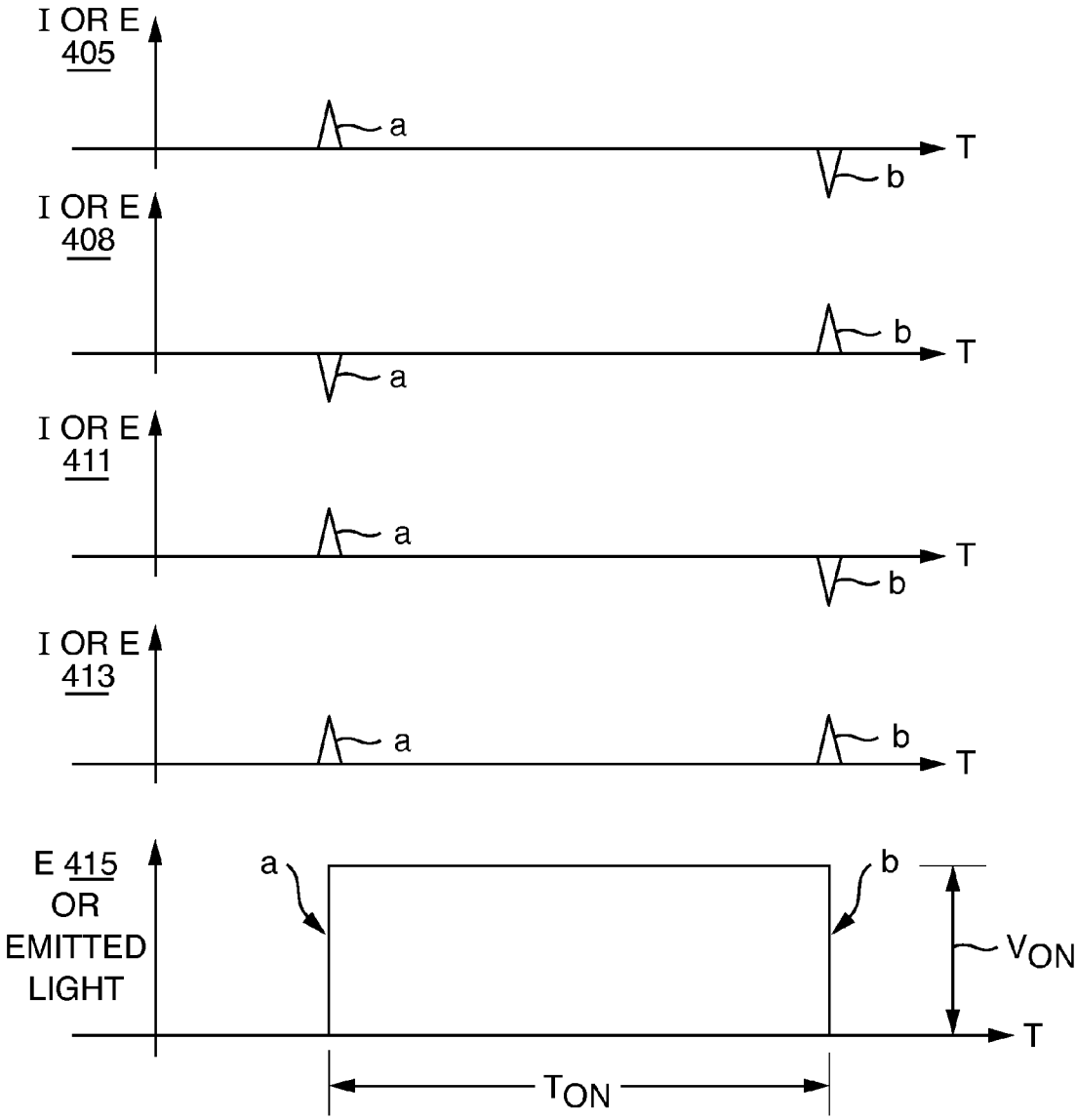
FIG. 5 is a timing chart showing the timing of the operation of the circuitry of FIG. 4.

FIG. 5 is a timing chart showing the timing of the operation of the circuitry of FIG. 4. As can be seen impulses 405*a*, 408*a*, 411*a* and 413*a* all occur virtually simultaneously and coincident with edge "a" of waveform E415. Likewise, impulses 405*b*, 408*b*, 411*b* and 413*b* all occur virtually simultaneously, but at a time subsequent to the occurrence of the "a" impulses, and coincident with edge "b" of wave form E415. That subsequent time is shown in FIG. 5 as $T_{on}$. This is the time when the LED is turned on by voltage E415 being applied across LED 103 and resister 416. Resistor 416 limits the current in the LED to appropriate current levels for the LED. For the duration of the $T_{on}$ time interval, the voltage E415 is equal to $V_{on}$ which is sufficient voltage to keep LED 103 energized for it to emit light.

The present invention is not limited to USB 2.0 or USB 3.0 cables and their connectors, nor to male only or female only plugs. The present invention is not limited to particular cable lengths of one foot, one meter or two meters; any length of cable may be used, consistent with power supplied by the power source. The present invention may thus have utility in a wider set of applications than only the cell phone battery charging, application described herein as, for example, in lighting up an LED held by a particular connector and thereby identifying that particular connector out of a sea of connectors plugged into a connector array panel. (Notably, a connector panel of 100 connectors by 100 connectors equals a large number of 10,000 connectors.)

For example, a touch sensitive capacitor circuit of the type shown in FIG. 4 can be positioned within an overmold in a connector plug (not shown) or jack (not shown) located, at the distal end of cable 104, i.e., adjacent or abutting power source 205, instead of being positioned as shown, with wiring running through cable 104 from the power source through the distal plug or jack to an LED, such as LED 103, in its depicted position at the other end of the cable. In this example, conductors 417 and 418 in FIG. 4 can be placed within cable 104 for conducting switched power from the distal end to the LED. In other words, power to the LED can be switched on and off by a user touching the overmold of the connector or jack which contains the circuit of FIG. 4 at the distal location near or adjacent the power source, while the LED remains located at the opposite end of the cable which is plugged into the array. This is accomplished by merely touching the connector mar the distal end next to the power source. In this manner, particular connector, in a sea of connectors, can self-identify by lighting up when the cable is touched at its distal end. For this self-identification application, the LED can be oriented radially, or in some direction other than the direction of axially-oriented. LED 103, so that its light is clearly visible from a distance.

In another alternative embodiment, an additional LED can be added to the connector and oriented radially to the direction of axially-oriented LED 103, thereby having two LED's in the connector, one directed axially and the other radially, when two LED's (with the same, or different, light colors) are deemed desirable in a particular application. In this other alternative embodiment, two separate variable capacitance switch circuits similar to 301 are used, one located proximate the LED's and the other located in the jack/plug at the distal end, each switch circuit operatively connected to only its respective LED.

In yet another alternative embodiment, with only one LED used in the connector, such as LED 103, there are two separate variable capacitance switch circuits each similar to 301 operatively connected to the same single LED, isolating diodes (or "or gate" diodes), similar to the configuration of diodes 409/410 in FIG. 4, are used, a first such diode (not shown) inserted in the output line 417 with its cathode connected to the anode of LED 103 and the other such diode (not shown) in the power line (not shown) coming from the distal end with its cathode also connected to the anode of LED 103. The single LED would then be lit in response to operating either switch, in response to a power command via the or gate established by these isolating diodes.

In a further alternative embodiment, because the LED shall be energized and emit light upon a user's touching the bottom of the overmold, and because there may be some reason why a lit LED is not desirable at a given moment under a particular circumstance, an additional switch, e.g., a finger-operated button switch, may be incorporated. This additional switch shall override the functionality of variable capacitor switch 301 and cut power from power source 205 over cable 104 that would otherwise feed variable capacitor switch 301. The button switch may be located within the connector plug proximate the power source at the distal end of the cable, or may be located in the other connector plug which also houses the variable capacitance switch 301. Alternatively, there may be two such button switches, one in each of those connector plugs, each controlling, power to the LED.

In this specification, various preferred embodiments have been described with reference to the accompanying drawings. It will, however, be evident that various modifications and changes may be made thereto, and additional embodiments may be implemented, without departing from the broader scope of the invention as set forth in the claims that follow. The present invention is thus not to be interpreted as being limited to particular embodiments and the specification and drawings are to be regarded in an illustrative rather than restrictive sense.

What is claimed is:

1. Apparatus comprising:

a connector plug affixed to one end of a cable, said connector plug having a flat or bottom side and a front face for mating with a connector-jack and electrical contacts protruding from said front face;

an LED supported by said connector plug and recessed into said front face to allow light emitted from said LED to illuminate said connector-jack while not interfering with said front face when said connector plug is being mated with said connector-jack;

a source of electric power operatively connected to the other end of said cable, said power being carried by dedicated wires in said cable to terminals on said LED to allow said LED to emit said light under control of a user; and a switch, included in said connector plug, said switch closing when said user touches said flat or bottom side without otherwise manually operating said switch, whereby said light illuminates said connector-jack when said switch is closed and when said connector plug is being mated with said connector-jack.

2. The apparatus of claim 1 wherein said cable is a USB cable, said connector plug is a micro USB plug and said connector-jack is a USB connector-jack.

3. The apparatus of claim 2 wherein said flat or bottom side is part of an overmold of said USB connector plug.

4. The apparatus of claim 3 wherein said switch is constructed from electrical parts including a touch-sensitive variable capacitor.

5. The apparatus of claim 4 wherein capacitance value of said variable capacitor varies from a quiescent default value when said user touches any part of said flat or bottom side.

6. The apparatus of claim 5 wherein said capacitance value of said variable capacitor returns to said quiescent default value when said user no longer touches said any part of said flat or bottom side.

7. The apparatus of claim 6 wherein said LED emits white light.

8. The apparatus of claim 7 wherein said front face is configured with a slanted flat surface over at least a portion of said front face, said apparatus further comprising a cell phone supporting said connector-jack, said connector jack containing a micro USB receptacle for receiving said protruding electrical contacts and configured with a complementary slanted flat surface to facilitate said mating.

9. The apparatus of claim 8 wherein said cell phone includes a rechargeable battery and is recharged from said source of electric power when said connector plug is mated with said connector-jack, said LED being energized by electric current from said electric power source via said two dedicated wires included in said cable but only when said flat or bottom side is touched by said user.

10. The apparatus of claim 9 wherein said source of electric power is another rechargeable battery and said cable is a dongle.

11. The apparatus of claim 1 wherein said other end of said cable includes another connector plug or another connector jack, said another connector plug or said another connector jack including another switch, said another switch closing when said user touches a flat or bottom side of said another connector plug or said another connector jack without otherwise manually operating said another switch, whereby said LED is illuminated at said one end of said cable by said user located at said other end of said cable.

* * * * *